United States Patent [19]

Kovalev et al.

[11] Patent Number: 4,976,051

[45] Date of Patent: Dec. 11, 1990

[54] ROTARY TRENCH EXCAVATOR

[75] Inventors: Evgeny P. Kovalev; Alexandr M. Sushkin; June V. Trubakov; Vladimir N. Shpektorov; Iosif N. Shpektorov, all of Moscow, U.S.S.R.

[73] Assignee: Spetsialnoe Konstruktorskoe Buro "Gazstroimashina", Moscow, U.S.S.R.

[21] Appl. No.: 372,374

[22] PCT Filed: Oct. 19, 1987

[86] PCT No.: PCT/SU87/00115

§ 371 Date: Jun. 15, 1989

§ 102(e) Date: Jun. 15, 1989

[87] PCT Pub. No.: WO89/03915

PCT Pub. Date: May 5, 1989

[51] Int. Cl.[5] ..... E02F 5/08

[52] U.S. Cl. ..... 37/94; 37/189

[58] Field of Search ..... 37/66, 91, 94–96, 37/97, 189; 172/123

[56] References Cited

U.S. PATENT DOCUMENTS 1,246,524 11/1917 Bager ..... 37/94

3,412,490 11/1968 Reising ..... 37/189

FOREIGN PATENT DOCUMENTS 609837 5/1978 U.S.S.R. .

644399 1/1979 U.S.S.R. .

1113483 9/1984 U.S.S.R. .

1158695 5/1985 U.S.S.R. ..... 37/91

*Primary Examiner*—Randolph A. Reese

*Assistant Examiner*—Arlen L. Olsen

*Attorney, Agent, or Firm*—Fleit, Jacobson, Cohn, Price, Holman & Stern

[57] ABSTRACT

A rotary trench excavator comprising a prime mover (1) pivotably connected to a movable frame (2) carrying a working member having the form of a system of drive rotors (9 to 11). To drive each such rotor (9 to 11), its interior accommodates a support frame (6) with support and guide rollers (7 and 8), and a drive mechanism. In order to ensure turning of each rotor (9 to 11) 180°, or of the entire system of rotors, there is provided an additional frame (4) connected to the frame (2) of the excavator and to each of the rotors (9 to 11) by way of detachable flanges (13 to 26).

3 Claims, 3 Drawing Sheets

ROTARY TRENCH EXCAVATOR

FIELD OF THE INVENTION

This invention relates to earth moving particularly to rotary trench excavators.

Rotary trench excavators according to the present invention can be used for laying service and water pipelines, and mostly for running oil and gas trunk pipelines, especially in very hard and permafrost soils.

BACKGROUND OF THE INVENTION

Rotary trench excavators are known to find a wide application for digging long distance trenches in a range of soils.

The use of single-bucket excavators in combination with drilling and blasting operations, or the use of ladder-type trenching machines is less productive and reliable.

There are known rotary trench excavators making use of crawler-type or sometimes wheel tractor pivotably connected to the working multi-bucket member. The working member can have a single rotor, or several kinematically or rigidly interconnected rotors.

For developing a sufficiently high pull force, especially for digging trenches of substantial cross-sections in very hard soils, the tractor, and eventually the entire trenching machine, must be very heavy. The overall weight of such an excavator is normally 50% greater than that of the proposed machine.

Expansion in the range of application of rotary trench excavators and their use for digging hard and permafrost soils, along with a growth in the length of pipelines and cross-section of trenches necessitate an increase in the pull force to be developed by the tractor or prime mover consequently resulting in a greater weight of the excavator and more power required for its movement.

Therefore, the use of single-rotor trench excavators is disadvantageous, or sometimes impossible.

More advantageous for use with high power prime movers is a construction of a trench digging member consisting of several independent rotors.

A construction which bears the closest resemblance to one to be herein described resides in rotary trench excavator (SU, A, 1,113,483) which comprises a semi-trailing working member including a movable frame with a wheeled support, and rotors mounted on a carrying frame. The carrying frame is disposed between the rotors and has cantilevers with ends thereof accommodated in the interior of the rotors. Soil is dug by this excavator at two sides of the pipeline resting on the ground, whereas part of the ground under the frame is removed by a passive mechanism, whereby it is impossible to dig a full-profile trench. In addition, with two rotating rotors the working member of the excavator fails to ensure digging in a direction coinciding with the movement of the machine or counter to the movement of the machine, since the first causes a vertical component of the digging force directed upwards, and the second causes a vertical component force directed downwards, both resulting in a moment acting in the lateral plane and therefore a higher dynamic range of the working member.

This technical solution makes it possible, in the case of using an independent drive for each rotor, to provide a working member wherein adjacent rotors rotate in the opposite directions only if one more active rotor of the same dimensions is installed therebetween, which necessitates displacement of such a rotor longitudinally to result in excessive length of the working member. Also, offsetting the rotors longitudinally calls for the provision of additional means for evacuating the soil being dug.

SUMMARY OF THE INVENTION

The invention aims at providing a trench excavator having a working implement of rotary type so constructed as to ensure trench digging with minimum consumption of power of trenches of substantial cross-section especially in hard permafrost grounds, reduce loads exerted on the engine, as well as to reduce the weight and simplify assembly and servicing of the excavator.

These and other aims are attained by that in a rotary trench excavator comprising a prime mover pivotably connected to a main movable frame carrying a working member in the form of a system of drive rotors having each in its interior a support frame with guide and support rollers and bearing in its rear portion on a wheeled support, according to the invention, there is provided an additional frame connected to the main movable frame of the excavator and to each of the rotors independently secured thereto to be capable of turning relative to these elements 180°, each rotor mechanism having its own drive.

Preferably, the system of rotors includes at least three rotor mechanisms.

Desirably, the support frames and the main movable frame are connected to the additional frame by means of detachable fixing means arranged symmetrically relative to the longitudinal and lateral axes of the system of rotors.

Such an arrangement of the rotary trench excavator allows to efficiently dig hard soils with the minimum of power expenditures.

The essence of the invention resides in the following.

Each independent rotor driven by its own drive is mounted by means of guide and support rollers on a support frame connected to the additional frame, which is in turn linked with the main movable frame of the excavator. All the attachment points of the support frames to the additional frame, and attachment arrangement of the additional frame to the main movable frame of the excavator are in symmetry to the longitudinal and lateral axes of the system of rotors. By virtue of such an arrangement each of the rotors, or the entire system of rotors is set, depending on the soil to be dug, in a position ensuring digging coinciding with the direction of movement of the machine or counter to such movement, which affords making trenches with the minimum of power expenditures.

One modified form of the proposed escavator envisages the arrangement of three independent rotors on the additional frame. This minimum number of rotors allows an arrangement of the working member, where the adjacent independent rotors rotate in the opposite directions. With two rotating rotors only part of the concept can be materialized, viz., changing the direction of rotation of the rotors when both rotors rotate in the direction of digging, or both rotors rotate in the direction opposite to digging. Joint rotation of the two adjacent rotors in the opposite directions for the utmost advantageous effect is impossible because the vertical component forces resulting from the digging action of the two rotors are directed oppositely and produce a torque resulting in inadmissible dynamic range of the working implement.

A modification with three independent rotors provides four combinations of arranging the system of rotors: all the three rotors rotate in the direction of digging or opposite thereto, two side rotors rotate in the direction opposite to the direction of trench digging with the middle rotor rotating in the opposite direction, or vice versa.

Rearrangement of each separate rotor or of the system of rotors is facilitated by the symmetrical detachable fixing means fashioned, for example, as flanges connecting the additional frame at the side of the upper plane to the main movable frame of the excavator, and at the side of the lower plane to the support frames of the rotors. When it is necessary to turn the separate rotors 180°, their support frames are disconnected from the additional frame to be turned and attached to the same spots of the detachable fixing means. When the whole system of rotors is to be turned, the detachable fixing means between the additional frame and the main movable frame of the excavator is disconnected.

A single-rotor excavator requires a pull force of 60 to 70 t to cope with loads arising during digging trenches 3×3 m in cross-section in very hard soils versus 35 to 40 t required by the proposed excavator. The weight of the proposed escavator is 150 t versus 180–220 t for a similar single-rotor excavator at the installed power 1200 hp for the proposed excavator and 2000–2500 hp for the prior art single rotor excavator.

Digging trenches of larger cross-section calls only for increasing the number of independent rotors (i.e., to four, five, six, or more rotors) without necessitating a higher pull force of the rpime mover, whereas in the single-rotor excavator the required pull force grows in direct proportion to the rotor capacity.

The invention makes it possible to provide a rotary trench excavator having a high capacity, capable of digging trenches in very hard and permafrost soils. The excavator has a moderate weight and is easy to transport.

Structural simplicity and ease of manufacture ensure reliable operation and simplify of servicing and preventive maintenance.

BRIEF DESCRIPTION OF THE DRAWINGS

These and other objects of the invention will become more fully apparent from a more detailed description of the preferred embodiments of the proposed rotary trench excavator with reference to the accompanying drawings, in which.

BEST MODE OF CARRYING OUT THE INVENTION

Figure 1:
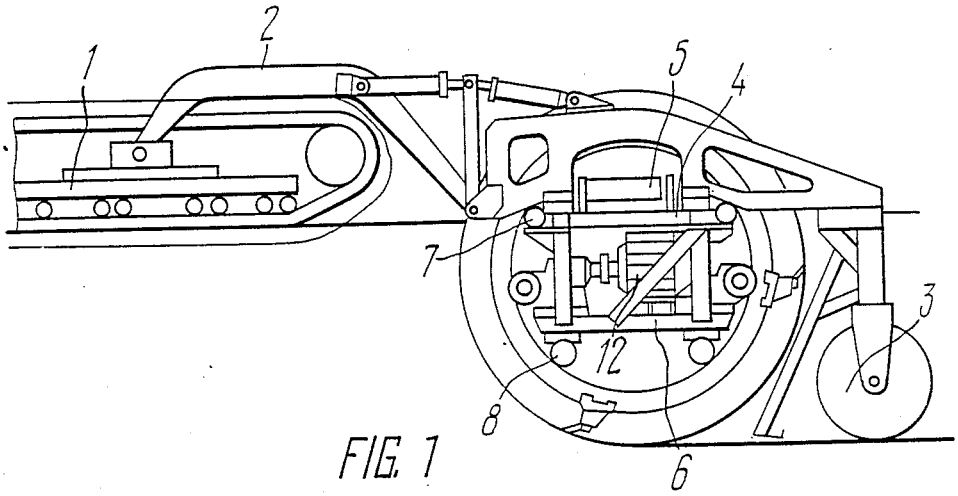
FIG. 1 is a general view of a rotary trench excavator in the working position.
Figure 2:
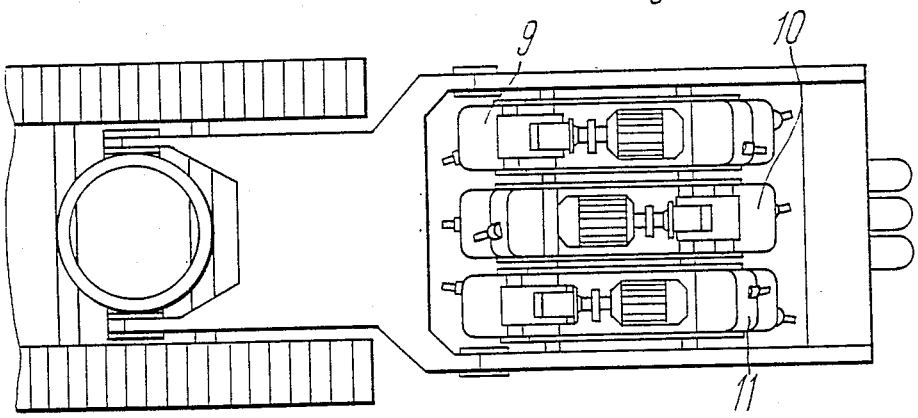
FIG. 2 is a top plan view of the proposed excavator showing a system of three rotors.
Figure 3:
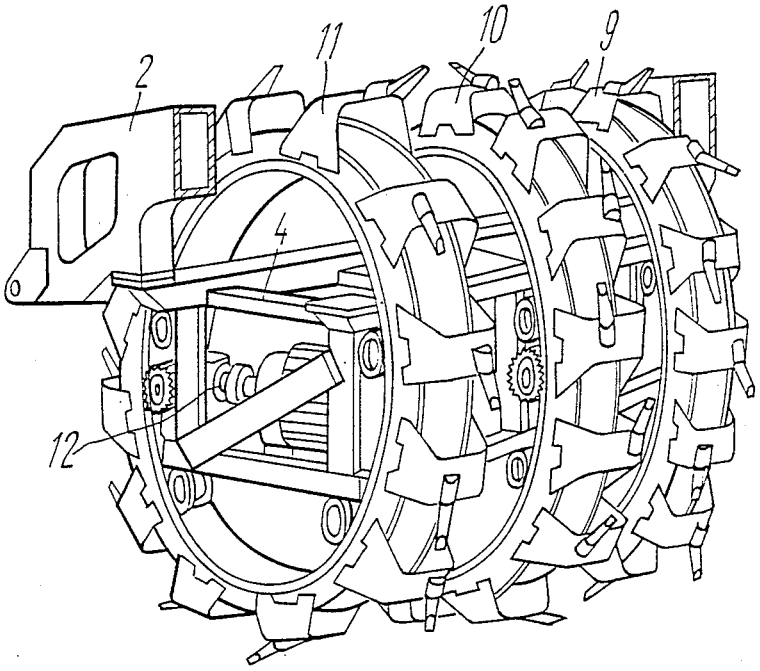
FIG. 3 shows a sectional axonometric view of a working implement illustrating one modified form of arranging the system of rotors with two rotors rotating counter to the direction of digging and one rotor rotating in the direction of trench digging.

A rotary trench excavator with reference to FIGS. 1 to 3 comprises a tractor 1 (prime mover), a movable main frame 2 bearing at its rear portion on a wheeled support 3. Connected to the movable frame 2 is an additional frame 4 carrying a conveyor 5. The conveyer 5 serves to evacuate the soil being dug. The additional frame 4 has support frames 6 having rotors 9, 10 and 11 mounted thereon by means of support rollers 7 and guide rollers 8. An individual drive 12 is accommodated inside each support frame 6.

Figure 4:
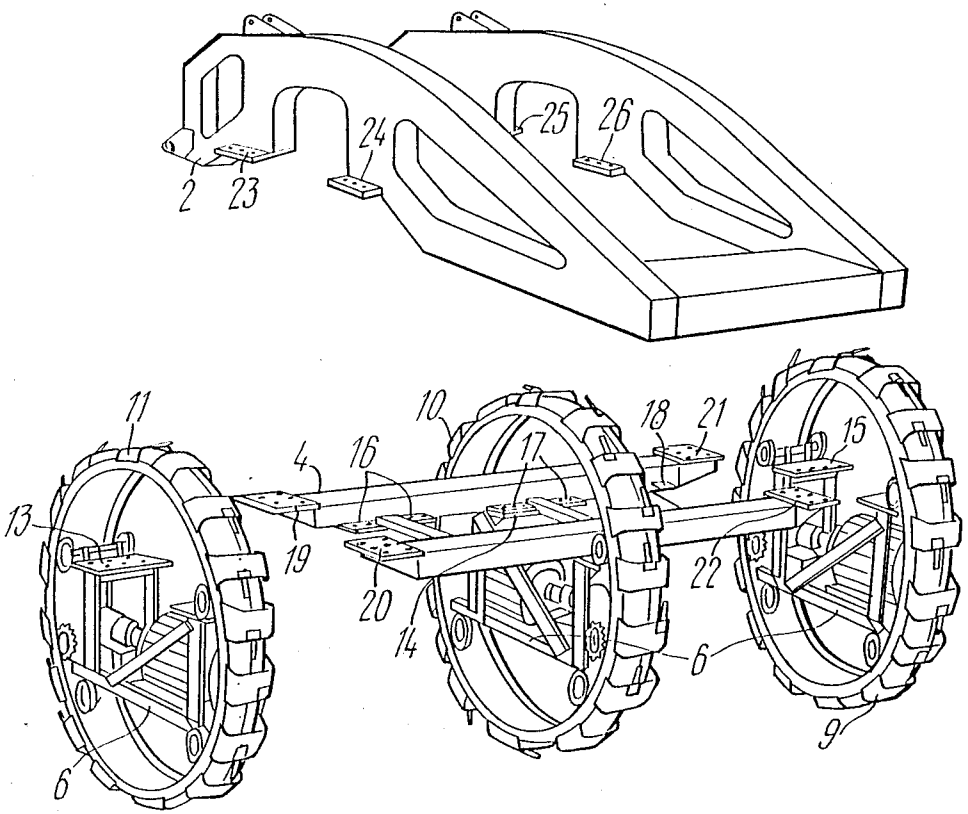
FIG. 4 is a fragmentary view of mounting the additional frame with one part of the main movable frame and independent rotors.

Referring now to FIG. 4, the support frames 6 are connected by mounted attachments fashioned as flanges 13, 14, 15 arranged symmetrically relative to the longitudinal and lateral axes of the system of rotors to similar flanges 16, 17, 18 of the additional frame 4; whereas by flanges 19, 20, 21, 22 symmetrical relative to the same axes the frame 4 is connected to flanges 23, 24, 25, 26 of the frame 2.

The heretofore described construction of a rotary trench excavator operates as follows. Soil is dug by virtue of the joint action of two movements, viz., rotational movement of the system of rotors 9, 10, 11 and translational movement of the prime mover 1.

The working member of the excavator is driven from a diesel-electric or diesel-hydraulic unit (not shown) accommodated on the prime mover.

Actuation of the individual mechanisms of the drive 12 results in rotation of the rotors 9, 10, 11, whereby they are rolled about the support and guide rollers 7 and 8 each bearing on the support frame 6. At the same time, the conveyer 5 is actuated.

The forward movement is transmitted from the prime mover 1 to the system of rotors through the movable frame 2, additional frame 4, support frames 6 and rollers 7, 8.

Having in mind that each rotor has an independent drive 12 the rotors 9, 10, 11 with support frames 6, rollers 7, 8 and drive 12 are mounted on the additional frame 4 with such a direction of rotation (in the direction of digging or in counter to digging) which ensures trenching a specific ground with the minimum of power expenditures.

Rearrangement of separate rotors is done by detaching its support frame 6 from the additional frame 4 along the flanges of the frame 6, removing it from the frame 4, turning it over 180°, and replacing it.

Rearrangement of the entire system of rotors is done by disconnecting the additional frame 4 from the main frame 2 along the flanges 19 to 26, turning the system over 180°, and replacing the rotor system.

INDUSTRIAL APPLICABILITY

The proposed rotary trench excavator ensures increased efficiency, lower dynamic range, and reduced pull forces and mass of the excavator thanks to the system of independent rotors enabling to dig soil in the direction of digging and in a direction counter to digging.

The invention can be preferable for use in continuous action earth moving machines, particularly in rotary trench excavators intended for making trenches of large cross-sections in hard and permafrost soils.

We claim:

1. A rotary trench excavator comprising a prime mover (1) pivotably connected to a movable frame (2) carrying a working member, said working member comprising an additional frame (4) connected to said movable frame (2); a plurality of support frames (6) each having guides (8) and support rollers (7) mounted thereon; each said support frame (6) independently detachably secured to said additional frame, a rotor rotatably mounted on the support rollers (7) and guided by the guide rollers (8) of each said support frame (6), a drive means mounted on each support frame (6) for driving each said rotor, each said support frame having means for securing said support frame to said additional frame to permit a first and a second rotational direction of its associated rotor, said first and second rotational direction being rotational opposites from each other; and a wheeled support (3) carried by said movable frame (2) behind said plurality of support frames (6) and their associated rotors.

2. A rotary trench excavator as claimed in claim 1, comprising at least three rotors.

3. A rotary trench excavator as claimed in claim 1, wherein said means for securing the support frames (6) and the main movable frame (2) to the additional frame (4) includes detachable fixing means (13 to 26) arranged symmetrically relative to the longitudinal and lateral axes of the system of rotors (9 to 11).

* * * * *